US008585472B2

(12) United States Patent
Wolff

(10) Patent No.: US 8,585,472 B2
(45) Date of Patent: Nov. 19, 2013

(54) ROTATIONAL TOOLS FOR THE ENGRAVING OF INTAGLIO PRINTING PLATES

(76) Inventor: Efram Wolff, Vashon, WA (US)

( * ) Notice: Subject to any disclaimer, the term of this patent is extended or adjusted under 35 U.S.C. 154(b) by 586 days.

(21) Appl. No.: 12/803,467

(22) Filed: Jun. 26, 2010

(65) Prior Publication Data

US 2011/0318120 A1 Dec. 29, 2011

(51) Int. Cl.
*B24D 15/00* (2006.01)

(52) U.S. Cl.
USPC ..... 451/524; 451/525

(58) Field of Classification Search
USPC ..... 451/523, 524, 352, 358, 508, 420, 178, 451/162, 163; 407/54
See application file for complete search history.

(56) References Cited

U.S. PATENT DOCUMENTS

| | | | | |
|---|---|---|---|---|
| 1,014,594 | A * | 1/1912 | Hakins | 15/244.1 |
| 6,751,875 | B2 * | 6/2004 | Jones | 30/392 |
| 7,188,628 | B2 * | 3/2007 | Shubert et al. | 132/73.6 |
| 2008/0085666 | A1 * | 4/2008 | Lindsay et al. | 451/293 |

OTHER PUBLICATIONS

Prior Embodiment of the Art Figures 8 and 9, Enclycopedia of DIDEROT en d'Alembert, 1777, France.
Enclycopedia of DIDEROT en d'Alembert 1777, France Page Depicting Tools Used for Manifre de Crayon to be found (Found) in HET ABC Van Prent' Amsterdam—Rukmuseum Booklet prior Embodiment of the Art Figures 8 and 9, Enclycopedia of DIDEROT en d'Alembert, 1777, France.

* cited by examiner

*Primary Examiner* — Dung Van Nguyen

(57) ABSTRACT

Improved hand tools having a rotational head assembly, which allow an artist to draw or engrave directly on a printing plate and create "random dot half-tones," for intaglio printing purposes. The tools can be used in conjunction with the other intaglio techniques of line etching, drypoint, engraving, hard ground etching, soft ground etching, aquatint, and especially mezzotint.

The improved tool has a handle with an axial centerline, a lengthwise side-surface and a tapered end with a bearing. A wheel with a shaft is received into the bearing. The wheel has a rotational center-point and a textured perimeter surface that is a smooth wheel surface permanently encrusted with a particulate material. The bearing can be offset from the axial centerline of the handle, to align the wheel between the lengthwise side-surface and the axial centerline of the handle. Preferably, sintered diamond particulate materials are bonded to the surface of a metal alloy wheel.

14 Claims, 4 Drawing Sheets

ROTATIONAL TOOLS FOR THE ENGRAVING OF INTAGLIO PRINTING PLATES

TECHNICAL FIELD OF THE INVENTION

The present invention relates to a group of hand tools having a rotational head assembly, which allow an artist to draw or engrave directly on a printing plate and create "random dot half-tones", for intaglio printing purposes. In addition, the tools are often used in conjunction with the other intaglio techniques of line etching, drypoint, engraving, hard ground etching, soft ground etching, aquatint, and especially mezzotint.

BACKGROUND OF THE INVENTION

A roulette is a type of engraver's tool originating in $18^{th}$ century Europe, for maniere de crayon, the technique for the reproduction of chalk and pastel drawings. The tools generally consist of a textured rotational wheel, fitted with a handle and used for drawing on a metal plate to be used in printing. The roulette tools currently available prior to the present invention create marks that fall into two basic categories: irregular but coarse and sparse, or, regular and mechanical. The marking surface used for the irregular marking tools use a coarsely textured ferrous wheel bearing some resemblance to chipped flint implements. Those tools that create regular marks employ steel wheels, which have been machined either with parallel lines or types of knurling. The marks that these wheels produce are mechanical in appearance. Those wheels having parallel lines machined into them originated as a tool used to touch-up photomechanical line-dot screens in commercial printing. These two referred to groups of markings often fail to integrate well with other fine art printmaking techniques, and typically can necessitate the use of etchants in order to create traces of the required depth.

Figure 1:
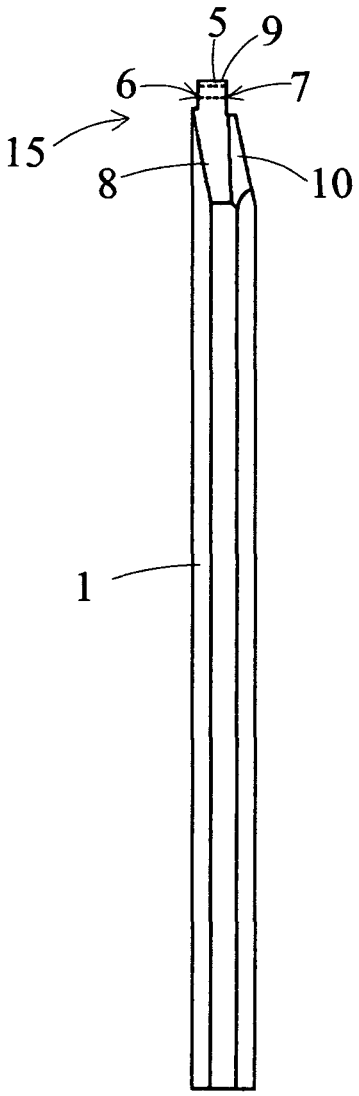
FIG. 1 shows a preferred embodiment of a handle for use as part of the rotational tool of the present invention.

Reference characters included in the above drawings indicate corresponding parts as discussed herein. The description herein illustrates preferred embodiments of the invention. However, the description herein is not to be construed as limiting the scope of the invention in any manner. It should be understood that the above listed FIGs. are not necessarily to scale, and details that are not necessary for an understanding of the present invention by one skilled in the technology of the invention, or render other details difficult to perceive, may have been omitted.

DETAILED DESCRIPTION OF SPECIFIC EMBODIMENTS

The Marking Wheel of the Improved Tool

In a preferred embodiment of the present invention, the marking wheel 2 of a rotational tool 20 is shown in FIGS. 3 through 5, 7 through 9, and 11 through 13, has an attached, contiguous and integral shaft, accordingly, "2" will be used as the numerical designation for the conjoined elements. The wheel is most preferably machined from a stainless steel alloy, with a perimeter surface 16 that is encrusted with a durable particulate 17. The preferred particulate is sintered diamond, standard mesh sizes 60/80, 80/100, or 100/120 are typically employed. The diamond particulate is bonded to the perimeter surface of the marking wheel, simply referred to herein as the "wheel." The perimeter of the wheel includes the outer edge of the wheel, and the diamond particulate is preferably bonded to the perimeter by conventional electroplating techniques, or by using other, privately held bonding technologies known to those who specialize in these processes.

When, as in the preferred embodiment, the stainless steel shaft is integral and contiguous with the wheel 2, it is masked or otherwise protected during the application of the particulate 17. The particulate textured perimeter surface 16 of the wheel 2 is the marking surface with which the printing plate is engraved. The stainless steel wheels to which the particulate is adhered preferably have a radial profile at the perimeter edges. This allows the user of the rotational tool 20 of the present invention, as simply referred to herein as the "improved tool," with a less restrictive range of contact area while drawing or marking on the printing plate, as the user can adjust the pivot of the tool angle freely. In instances where a broad rather than a fine line is required, the profile of the stainless steel wheel used has a profile with a somewhat wider, flat mid-section, providing a contact point of greater breadth, however, a slight radial detail is retained at the edge in order to soften the quality of the drawn line. The particulate encrusted surfaces of the perimeter 16 and the outer face 12 of the wheel can also occasionally be used in a fixed non rotational manner, in this application an outer face with a convex "domed" profile is preferable.

A most preferred wheel 2 used on the improved tool 20 of the present invention has a diameter of approximately six mm, with wheels of a smaller diameter certainly available as an alternative. The wheels having a smaller diameter are typically utilized for instances in which the platework undertaken includes tighter radial passages, or in work of a smaller scale.

The Perpendicularly Formed Improved Tool:

FIGS. 1 through 5, and 10 through 13 refer to the improved tool 10 of the present invention having the marking wheel 2 perpendicularly oriented to the tool handle 1. FIGS. 1 through 5 show a perpendicular form of the improved rotational tool having a contiguous, fixed, and faceted bearing 5 machined at one end of the handle 1.

A preferred embodiment of the handle in the perpendicular form of the improved tool 20 is shown in FIG. 1, with the tool having a hexagonal handle 1. Although an aluminum alloy is a preferred material, other rigid materials such as plastic, brass, or even wood, could be used to good effect, and with various cross-section profiles, such as round, elliptical, or square, as desired.

Figure 3:
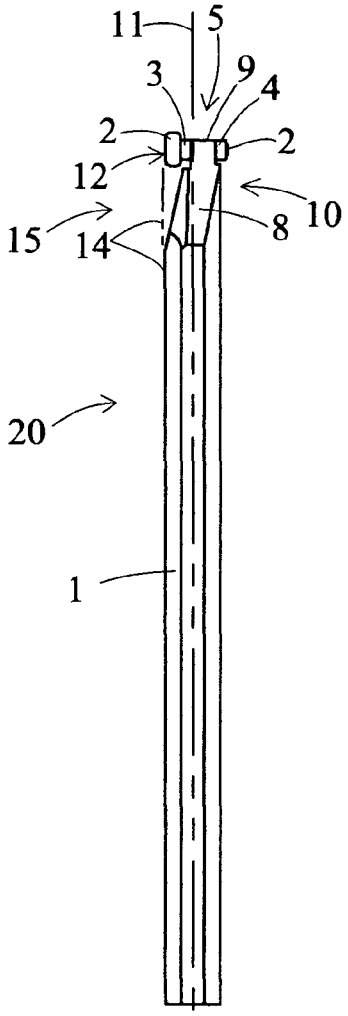
FIG. 3 shows a preferred embodiment of the rotational tool of the present invention.
Figure 4:
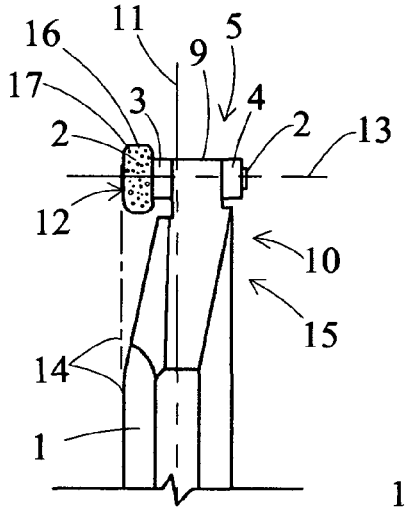
FIG. 4 shows an enlargement of a preferred embodiment of the bearing and wheel assembly, for use as part of the rotational tool of the present invention.

Specifically, a preferred handle 1 includes an axial centerline 11, as shown in FIGS. 3 and 4, and the handle has a lengthwise side-surface 14, which can be visually extended as also shown in FIGS. 3 and 4, beyond the tapered end 15 of the handle, with the bearing 5 on the tapered end of the handle, which is either attached or integral to the handle, as discussed herein.

Most preferably, two opposing surfaces 6 and 7 of the hexagonal material, as shown in FIG. 1, are reduced in size using a milling machine to form opposing flats. One of the flats 7 is cut deeper moving it closer to the center of the material. This creates an offset of the lateral axial location of one side of the bearing 5, as shown in FIGS. 1, 3 and 4 in reference to the lengthwise center line of the handle. The deeper of the two milled flats 7 will serve as the wheel side. The opposing, and shallower cut or flat 6 will serve as the seat for a locking washer. The offset created by the asymmetry of these two cuts positions the wheel in a location which facilitates improved balance and optical benefit in the use the tool 20 of the present invention.

Specifically, the wheel 2 includes an outer face 12 and a rotational axis 13, as shown in FIGS. 3 and 4, and the wheel preferably has an integral shaft that extends along the rotational axis of the wheel. Again, the wheel also includes a perimeter surface 16, which is textured with a particulate material 17. The rotational axis of the wheel is approximately perpendicular to the axial centerline of the handle. Additionally, the bearing 5 is offset from the axial centerline of the handle, to align the outer face of wheel with the lengthwise side-surface 14 of the handle 1.

Figure 2:
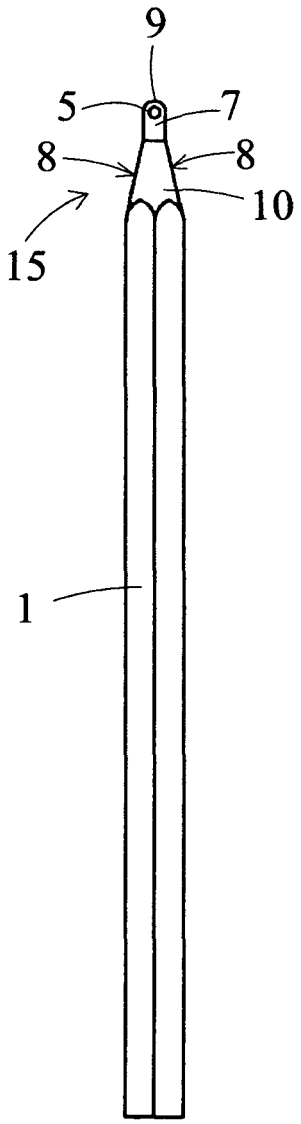
FIG. 2 shows a preferred embodiment of a handle for use as part of the rotational tool of the present invention.

In FIG. 2, it is shown that two of the "stock" or factory flats of the handle 1, as perpendicular to the above mentioned milled flats, 6 and 7, are cut at oblique angles 8, on either side and then, harrow to straight and produce a narrower projection, which terminates in a bullnose 9. The bullnose has a bore in it which serves as the bearing 5, as shown in FIG. 2, for the stainless steel shaft integral to the wheel/shaft unit 2 as shown in FIGS. 3 through 5.

As shown in FIG. 1, on the wheel-side milled flat 7 of the improved tool 20, from the point which was mill-cut to the two points immediately to the left and right of it, a faceted taper 10 is milled and can be additionally 'chased' by turning, creating a taper which resembles a section of a sharpened pencil. Preferably, for the tapered end of the handle, the conical passage at its widest point is approximately 40% of the radial area of the handle material. This taper 10 assists the user by creating a sight line, which presents the visually familiar reference of a conventional pencil.

Referring to FIGS. 3 and 4, when the improved tool 20 of the present invention is assembled, two washers can flank either side of the bearing 5. When in this configuration, the two washers are preferably made of an acetyl, although other forms of plastic can be substituted. Adjacent to the deeper of the two mill-cuts is the spacer washer 3 which maintains the desired distance between the wheel and the bearing and prevents the textured perimeter of the wheel 2 from dragging against the side of the bearing. The opposing and more shallow mill-cut is made to allow a locking washer 4 to seat squarely against it.

Figure 5:
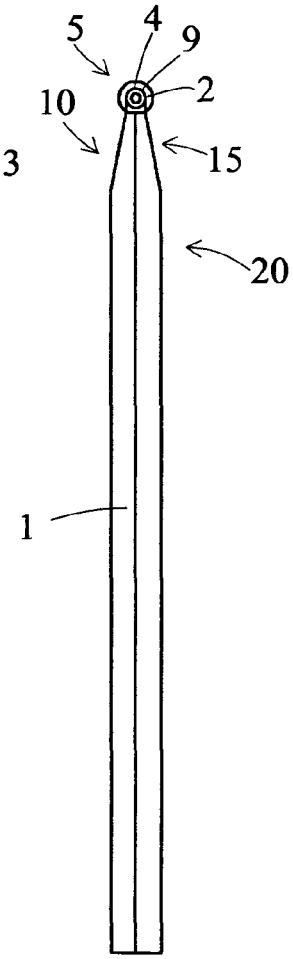
FIG. 5 shows an enlargement of a preferred embodiment of the bearing and wheel assembly, for use as part of the rotational tool of the present invention.

FIGS. 3 through 5 show the shaft, which is an integral part of the wheel/shaft 2, installed in and through the contiguous, machined, fixed bearing 5 shown in FIGS. 1 through 5. Specifically, FIGS. 3 and 4 show the spacer washer 3, made of acetyl, installed on the shaft of the wheel/shaft unit 2 and pressed tight to the wheel. After the installation of the spacer washer 3, the shaft has been selectively lubricated with a specialized 'non-wicking' oil, applied only to that section which will remain in contact with the bore of the bearing 5, as shown in FIGS. 1 through 5. Following the application of the lubricant, the shaft portion of the wheel/shaft 2 has been inserted into the bore of the bearing 5, seating the bearing-facing side of the spacer washer 3, against the more deeply milled flat on the wheel side.

FIGS. 3 through 5 show the locking washer 4 pressed onto the shaft end of the wheel/shaft 2, where it protrudes from the bore of the bearing 5, seating against the milled flat 6 as shown in FIG. 1, and serving as a locking retainer. The locking washer is easy to dismount from the shaft end in order to permit removal, replacement, and installation of the wheel/shaft unit.

The Concentrically Formed Improved Tool

Figure 6:
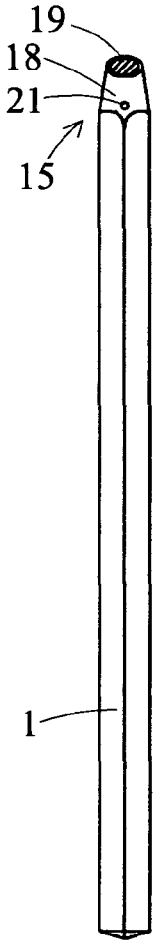
FIG. 6 shows a preferred embodiment of a handle for use as part of the rotational tool of the present invention.
Figure 7:
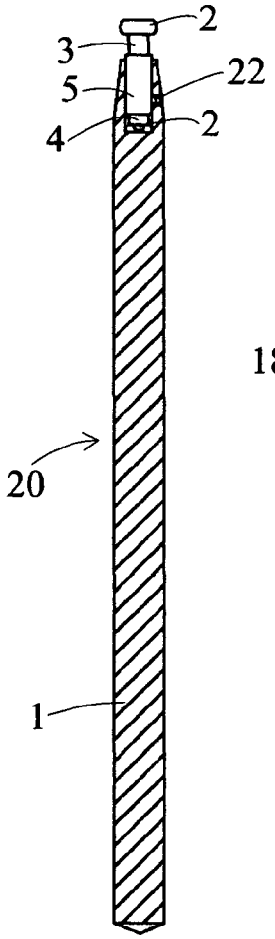
FIG. 7 shows a preferred embodiment of the rotational tool of the present invention, with the handle in cross-section.
Figure 8:
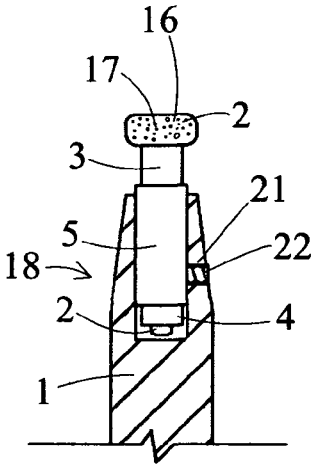
FIG. 8 shows an enlargement of a preferred embodiment of a bearing and wheel assembly, for use as part of the rotational tool of the present invention.
Figure 9:
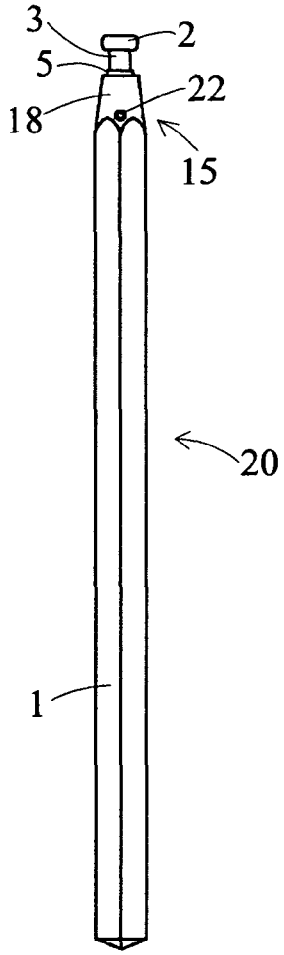
FIG. 9 shows an enlargement of a preferred embodiment of the bearing and wheel assembly, for use as part of the rotational tool of the present invention.

FIGS. 6 through 9 refer to the improved tool 20 of the present invention having the rotational parts concentric with the handle. Specifically referring to FIG. 6, in this alternative preferred embodiment the concentric form of the rotational tool has a hexagonal handle 1 although again, an aluminum alloy is the preferred handle material, other rigid materials in various profiles, such as plastic, brass, or even wood could be used to good effect. One end of the handle material is preferably conically tapered 18 as in a sharpened pencil. The tapering of the handle end may be a conical tapering, or a faceted tapering as preferably employed with the perpendicularly formed tool, as discussed above. The conically tapered end is center bored, to form a hollow 19. The conical taper is bored 21 through to the hollow in a perpendicular orientation and tapped to receive a set screw 22, as shown in FIGS. 7 through 9.

In FIGS. 7 and 8, the handle 1 is shown in cross-section, revealing how the bearing bushing 5 is installed in the bored hollow. A preferred material for the bearing is an acetyl material, which is especially suited to this application due to its self-lubricating properties. Other materials such as a brass or "Oilite" brand of bronze can also serve as bearing material for this form of the improved tool 20.

The hole of the bearing/bushing receives the shaft of the wheel/shaft unit 2. The shaft of the wheel has a plastic spacer washer 3 pressed onto the shaft to assist in its ability to turn freely. The shaft is then inserted through the hole in the bearing/bushing 5 after which protruding shaft end has a plastic locking washer 4 pressed onto it as a retainer.

As shown in FIG. 6 the handles 1 for the alternative concentric form of the rotational tool 20 may be produced in both hexagonal and round material. The handle of the concentric form is suited as well to receive a bearing machined to accommodate the wheel/shaft in a perpendicular orientation. This alternative form is shown on drawing sheet 4.

Alternate Form of the Perpendicular Improved Tool

Figure 10:
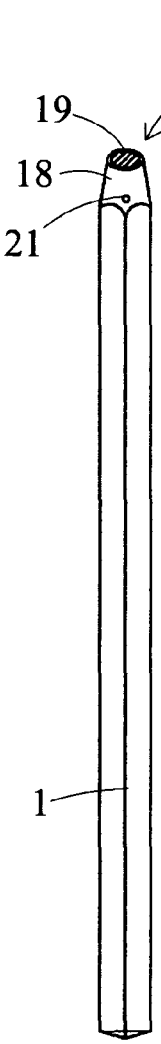
FIG. 10 shows a preferred embodiment of a handle, for use as part of the rotational tool of the present invention.
Figure 11:
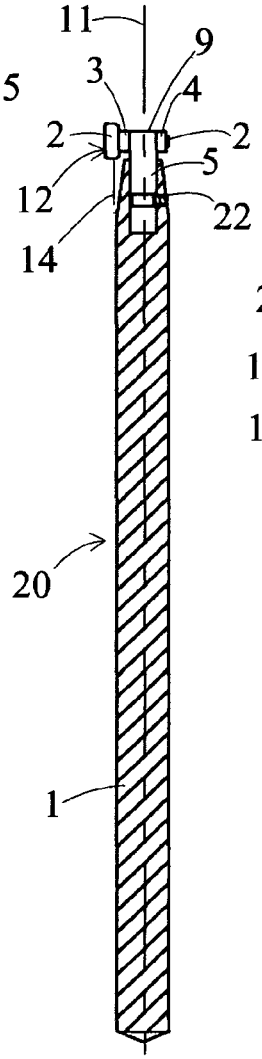
FIG. 11 shows a preferred embodiment of the rotational tool of the present invention, with the handle in cross-section.
Figure 12:
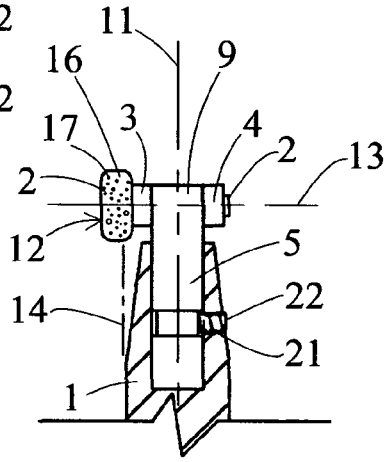
FIG. 12 shows an enlargement of a preferred embodiment of the bearing and wheel assembly, for use as part of the rotational tool of the present invention.

FIGS. 10 through 13 refers to a preferred embodiment of the improved tool 20 of the present invention, in which the wheel is perpendicular in orientation to the handle 1. In this alternate form, the bearing 5, as shown in FIGS. 11 and 12, is comprised of a separate, removable unit, rather than being contiguous and fixed. A primary advantage of this form of the improved tool is that it allows the artist-engraver a choice of interchangeable bearing/wheel orientations.

Figure 13:
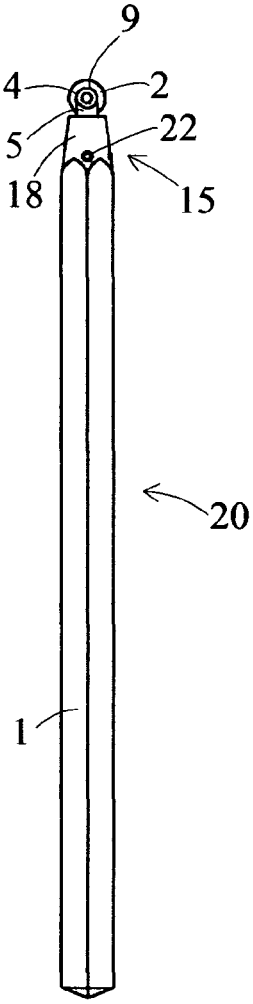
FIG. 13 shows a preferred embodiment of the rotational tool of the present invention.

FIG. 10 shows a sectioned view of the handle 1 in this preferred embodiment of the improved tool 20. Although aluminum alloy is a preferred handle material, other rigid materials such as plastic, brass, stainless steel, or even wood could be used to good effect. One end of the handle material is preferably conically tapered 1 as in a sharpened pencil. The conical taper is center bored, to form a hollow 19. The conical taper 18 is bored through to the hollow in a perpendicular orientation 21 and tapped to receive a set screw 22, as shown in FIGS. 11, 12 and 13.

FIGS. 11 and 12 show the improved tool 20, with the handle 1 in cross-section. The bearing 5 is shown inserted into the hollow and is secured by the set screw 22. The preferred material for the bearing 5 is "Oilite" brand of bronze material, although suitably rigid materials having sufficient bearing qualities for this purpose such as brass or aluminum could be used. The preferred profile of the material used to create the bearing is solid round stock. As the proper length is parted, it receives a pass from the lathe to size it to the hollow 6, as shown in FIGS. 1 and 2. A concentric groove or a drilled and tapped hole are preferably machined at the tail end of the bearing stock to receive the set screw 22, as shown in FIGS. 11 through 13.

The bearing 5 is preferably produced by using a milling machine to produce two milled flats 6 and 7, as shown in FIG. 1. The two surfaces adjacent to the milled flats are then milled flat as well, producing a narrow projection which terminates in a bullnose 9, as shown in FIG. 2. The bullnose has a bore in it which serves as the bearing 5, as shown in FIGS. 1 and 2.

FIGS. 11 and 12 show the integral wheel/shaft unit 2 with the spacer washer 3 pressed onto the shaft and inserted through the bore of the bearing 5, the locking washer 4 is pressed onto the protruding shaft end, the preferred material of the washers is acetyl. This alternative form of the improved rotational tool 20 has a the advantage that a bearing with either a concentric or a perpendicular wheel orientation can be installed into the handle. The bearing 5 can also be fabricated using square stock. The conically tapered end of the handle 18 in this alternate form (not shown), has a notch milled into it to receive the square end of the bearing 5. The same use of a perpendicular tapped bore 21, set screw 22, and a recess for the set screw is used to hold the bearing in place. In this embodiment the bearing has a tapped hole to receive the set screw.

An additional form of the improved tool 20 in the perpendicular orientation, which also uses the materials unique and novel to the present invention, presents the shaft as fixed to the handle, and the wheel, fashioned from the described materials, with a center bore.

The Use of the Improved Rotational Tool:

To employ the improved rotational tool 20 of the present invention, an artist-user or practitioner engraves on a printing plate by grasping the tool handle 1 FIGS. 3 through 5, 7 through 9, 11 through 13, allowing the marking wheel, 2 to find a secure purchase on the printing plate and pushing forward with varying degrees of pressure. The manner in which the tool is held may vary. In general, the user either holds the tool handle similarly to a pencil, or especially in the case of the concentric species, the handle may be held like a large charcoal stick, as if holding a handle-bar. Most practitioners "draw" by manipulating or rolling the tool back and forth.

Additionally, the concentric embodiment of the tool 20 can be adjusted by tightening the set-screw to have a fixed marking surface, which, when the handle 1 is fitted with a "domed" textured part can be used as a mattoir (a small mace). The mattoir is a tool used in conjunction with roulettes and is held in the fist in a vertical orientation to the printing plate and rocked to produce a non-linear even field of tonal dots. The tools of larger sizes are often preferable for this type of use or application.

Although intended specifically to be used directly on the printed plate, the improved tool 20 of the present invention can be used in conjunction with acid and acid resist techniques and methods. The improved tool offers the user a familiarity of feel, when in one's hand, owing to the handle's modeling on various common pencil sizes. Additional benefits inherent to use of the present invention are the smoothly tracking and stable and 'wobble free' wheel. In the perpendicular form of the improved tool, the taper above the marking wheel provides the user with the familiar "sightline" that a user is accustomed to when using a sharpened pencil. The concentric form of the tool offers the user the same hand position used by many artists who draw with larger leads, chalks and charcoal.

Although copper is the preferred material for the printing plate owing to its durability and easy working for making corrections, many artists prefer zinc alloys as alternatives. Various forms of plastic sheets may also be used, owing to cost considerations. The marks created by the improved tools have much in common with those of pastel or pencil when seen on a printed proof.

Preferably, the plates for use with the improved tool 20 of the present invention are printed in the same manner as other intaglio methods. This involves applying printing ink to the plate and carefully removing the excess until only the lowered traces and burrs hold ink whilst the top surface is wiped clean. The plate is then typically placed on an engraver's press (similar to a mangle), overlaid with a damp sheet of paper, then felt packing blankets and the platen laden with the above materials is driven between the two cylinders in order to transfer the ink to the paper. The resulting proofs taken from the plate, owing to the use of the particulate encrusted parts, have a quality more in keeping with other fine art mediums, such as drawing and pastel, than those achieved by using tools which have ferrous marking surfaces.

Until the improved tools 20 of the present invention, rotational tools used for plate making were typically fitted with textured ferrous wheels, typically of hardened steel, to produce marks having a mechanical appearance which is similar to those seen in the modern commercial printing processes from which they originated.

By employing the particulate encrusted 17 and improved tools 20 of the present invention, for the purpose of drawing and mark making in the creation of intaglio printing plates, a great benefit is realized. The improved tools provide a significant improvement over previously used tools utilizing textured ferrous wheels and other textured surfaces in both fixed and rotational tools of this type.

An additional innovation in the improved tool 20 is that the parts containing the marking surfaces are replaceable, and, in forms having interchangeable bearing assemblies, allow the artist to change the orientation of the wheel to the handle. Wheels varying in coarseness offer the user a choice of dot size.

The proofs obtained from plates in which the improved tools 20 have been used, exhibit passages that are similar in appearance to pastel or pencil drawings, as do those of their 18th century predecessors. The tools from the $18^{th}$ century were primarily used in conjunction with acid and acid resist methods and techniques. Importantly, the improved tools of the present invention are instead created specifically to be used directly on the printing plate. The use of acid and acid resist requires considerable expense, time and experience and involves hazardous chemical exposures.

In a group environment, particularly at educational facilities, the ability to create an image with a range of half-tones by drawing directly on the plate surface and create marks of the sufficient profundity required for printing an edition is a considerable advantage. All of the techniques in which one physically works the printing plate rather than etching it displace the metal of the plate, rather than removing it, this displacement results in 'burrs.' Some artist-engravers elect to treat the burrs and the printed effects they produce as an element of the medium, conversely if one desires a crisper, and spare appearance, one may wish to minimize or remove the burr. The marks created by employing the tools of the present invention are such that they endure and can provide a dependable ink holding trace, even if one elects to gently 'deburr' the displaced metal that all physical plate work creates. Of the conventional roulettes employing a steel or ferrous wheel, only those which produce a very grainy coarse dot pattern will withstand deburring. However, such wheels are not suitable as an expressive and exacting drawing tool. Conversely, the tools of the 18th century, based on the results which they produced, and the improved tools employing the features of the present invention, are particularly suited to achieving fine and expressive rendering or sketching.

Additionally, contemporary and conventional roulettes produce either a dot pattern with a mechanical appearance, owing to the use of a machined or "knurled" wheel, or a very sparse and coarse dot, due to the nature of their coarsened steel wheels. In contrast, the dot patterns produced by the improved tool 20 are random, however in such close proximity to one another, so as to create the continuity and cohesion seen in works drawn directly on paper.

An additional benefit of the improved tool 20 of the present invention, in differentiation from those of its predecessors, is that the "wear parts," which produce the marks on the plate are replaceable. Although the marking surfaces of the improved tools as shown and described herein are new in form, the resultant marks they produce intentionally bear a similarity to the marks created by the tools used in the $18^{th}$ century, as typified in the well known "*Encyclopedia of Diderot*." With the improvements of the present invention, the marks created by the improved tools described herein, create an appearance with both density and dot size that is consistent with that of the classical drawing techniques in fine art mediums.

In compliance with the statutes, the present invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A rotational tool for the engraving of a printing plate, the rotational tool comprising:

a handle, the handle sized to be held in a hand of a user, the handle having an axial centerline, a lengthwise side-surface and a tapered end;

a bearing on the tapered end of the handle;

a wheel having an outer face and a rotational axis, and the wheel having a shaft that extends along the rotational axis of the wheel, and the wheel having a textured perimeter surface;

the rotational axis of the wheel approximately perpendicular to the axial centerline of the handle, and the shaft of the wheel received into the bearing;

the wheel rotatable within the bearing; and the bearing offset from the axial centerline of the handle, to align the outer face of wheel with the lengthwise side-surface of the handle.

2. The rotational tool of claim 1, wherein the textured perimeter surface of the wheel is permanently encrusted with a particulate material.

3. The rotational tool of claim 2, wherein the particulate material is a sintered diamond powder.

4. The rotational tool of claim 1, wherein the bearing is a self-lubricated plastic material.

5. A rotational tool for the engraving of a printing plate, the rotational tool comprising;

a handle, the handle sized to be held in a hand of a user, the handle having an axial centerline, a lengthwise side-surface and a tapered end;

a bearing on the tapered end of the handle;

a wheel having an outer face and a rotational axis, and the wheel having a shaft that extends along the rotational axis of the wheel, the wheel having a textured perimeter surface, and the textured perimeter surface is a smooth wheel surface permanently encrusted with a particulate material;

the rotational axis of the wheel approximately perpendicular to the axial centerline of the handle, and the shaft of the wheel received into the bearing; and the wheel rotatable within the bearing; and the bearing offset from the axial centerline of the handle, to align the outer face of the wheel with the lengthwise side-surface of the handle.

6. The rotational tool of claim 5, wherein the particulate material is a sintered diamond powder.

7. The rotational tool of claim 5, wherein the bearing is a self-lubricated plastic material.

8. A rotational tool for the engraving of a printing plate, the rotational tool comprising:

a handle, the handle sized to be held in a hand of a user, the handle having an axial centerline, a lengthwise side-surface and a tapered end;

a bearing on the tapered end of the handle;

a wheel having an outer face and a rotational axis, and the wheel having a shaft that extends from the rotational center point of the inner surface of the wheel;

extending along the rotational axis of the wheel, and the wheel having a textured perimeter surface;

the rotational axis of the wheel approximately perpendicular to the axial centerline of the handle, and the shaft of the wheel received into the bearing;

the wheel rotatable within the bearing; and the bearing offset from the axial centerline of the handle, to align the outer face of the wheel with the lengthwise side-surface of the handle.

9. The rotational tool of claim 8 wherein the bearing is provided by a perpendicular bore through the bullnose in the tapered end of the handle.

10. The rotational tool of claim 8 wherein a spacer washer determines the distance from the inner surface of the textured wheel to the side surface of the bearing; allowing for the adjustment of the alignment of the outer face of the wheel with the lengthwise side-surface of the handle.

11. The rotational tool of claim 8, wherein the textured perimeter surface of the wheel is permanently encrusted with a particulate material.

12. The rotational tool of claim 8, wherein the particulate material is a sintered diamond powder.

13. The rotational tool of claim 8, wherein the wheel is secured by a plastic lock washer on the shaft of the wheel.

14. The rotational tool of claim 8 wherein the offset spacing of the wheel to the bearing is maintained by a plastic spacer washer on the shaft of the wheel.

* * * * *